United States Patent [19]

Piucci et al.

[11] 4,346,014

[45] Aug. 24, 1982

[54] ROLLING OIL COMPOSITIONS AND METHOD OF INHIBITING CARBON SMUT ON BATCH ANNEALED STEEL

[75] Inventors: Joseph A. Piucci, Royersford; Kurt Goltz, Exton, both of Pa.

[73] Assignee: Pennwalt Corporation, Philadelphia, Pa.

[21] Appl. No.: 255,605

[22] Filed: Apr. 20, 1981

[51] Int. Cl.[3] ..... C10M 1/38

[52] U.S. Cl. ..... 252/47.5; 72/42; 72/46

[58] Field of Search ..... 252/49.5, 51.5 R, 47.5; 72/42, 46

[56] References Cited

U.S. PATENT DOCUMENTS

| | | | |
|---|---|---|---|
| 2,066,173 | 12/1936 | Calcott et al. | 252/51.5 R |
| 3,265,620 | 8/1966 | Heiman | 252/51.5 R |
| 3,267,037 | 8/1966 | Mitacek et al. | 72/42 |
| 3,632,487 | 1/1972 | Brown et al. | 204/34 |
| 3,779,818 | 12/1973 | Shoemaker | 148/6.14 R |
| 3,907,612 | 9/1975 | Atkiss et al. | 148/14 |
| 4,062,784 | 12/1977 | Baur | 252/49.5 |
| 4,214,924 | 7/1980 | Piucci | 148/18 |

*Primary Examiner*—Charles F. Warren
*Assistant Examiner*—Y. Harris-Smith

[57] ABSTRACT

Carbon smut on post-annealed cold rolled steel sheet and strip is inhibited by a process using a rolling oil containing from 0.5 to 5% by weight of specific organic nitro compounds in the cold rolling oil. The steel sheet and strip are substantially smut free after batch annealing. Rolling oils and their aqueous emulsions containing the organic nitro inhibitors are also disclosed and claimed.

8 Claims, No Drawings

ROLLING OIL COMPOSITIONS AND METHOD OF INHIBITING CARBON SMUT ON BATCH ANNEALED STEEL

BACKGROUND OF INVENTION

In the manufacturing of automotive and appliance grade steel sheet and strip, red hot steel slabs are hot reduced in one or several steps into a steel band of about ¼" thickness. In this operation, a heavy mill scale of iron oxides forms on the steel which has to be removed by acid pickling. This operation leads to considerable losses of metal from the surface. For further reduction, the surface area is increased manyfold and hot rolling becomes impractical. Therefore, the hot band is reduced further by cold rolling. For this step, it is essential to employ a rolling oil to reduce friction and to facilitate a larger cross sectional reduction. Cold rolling of carbon steel introduces work hardening, which can be considerable in modern multi-stand mills. Too much hardening renders the sheet metal unsuitable for further forming operations, be it tight bending, deep drawing, punching or further gauge reduction. To remove the excess hardness, the steel has to be annealed by heating it for about 10 to 12 hours to temperatures between 1000° and 1400° F. in a reducing atmosphere.

After the cold rolling step, the rolling oil is usually left on the steel, partly for rust protection for the time in storage prior to anneal, but mainly because of the expense in removing it. Cleaning steel is costly because it requires extra process equipment. It cannot be done in-line with the rolling operation because cleaning requires considerably more time than rolling. Occasionally, a mill cleaner is applied in line but because of the high speed, only marginal cleaning is achieved, i.e. an oil film from the rolling oil remains on the steel. Usually the steel sheet, rolled up in large coils, is annealed with an oily surface.

Modern rolling oils are mixtures of many different compounds. They are normally applied from a water based emulsion in concentrations from 0.5 to 15%. The main ingredients are mineral oils (i.e. hydrocarbons), fatty oils and greases (i.e. polyalcohol esters of fatty acids), and fatty amides. Other additives are present which are necessary for a satisfactory performance, such as detergents, emulsifiers, fungicides, bactericides, antioxidants and high pressure lubricant additives. None of these compounds is stable at a temperature above 1000° F. In air, they simply burn off. In the reducing atmosphere used in the annealing chamber, the rolling oil decomposes. Some of it is distilled off, but enough of it breaks down into gaseous products and higher weight materials which finally end up as a carbonaceous layer on the steel surface called carbon smut. The amount of carbon smut deposit and its structure depends on many parameters, i.e. composition of the rolling oil, type of steel, rate of heatup, duration of heat cycle while annealing, peak temperature and type of annealing gas. In most cases, the presence of carbon smut on the steel surface is detrimental for later surface treatments.

Most of the steel sheet is used for manufacturing products that will later receive an organic finish such as a paint or polymer coating. To get a useful life out of a paint coat, a proper surface preparation is essential. This mostly requires a conversion coating based on phosphates, which acts as an adhesion promoter and corrosion stopper in case of physical damage to the paint.

Phosphate coatings are applied from mildly acidic water based solutions. Although some carbon smut deposits on annealed steel are loose and can be washed off, many are very dense and form a tenaceous skin that resists industrial cleaners. Even the acidity in the phosphating solution is not sufficient to penetrate the dense carbon deposits of smutted steel and very poor phosphate coatings are obtained. The only certain ways to remove the carbon smut sufficiently are either mechanically by surface grinding or by shot blasting, or chemically by strong acid pickling. Both such types of preparation are expensive and time consuming and often not possible to integrate in existing production lines.

SUMMARY OF THE INVENTION

We have now discovered a process for cold rolling steel sheet or strip whereby it is produced substantially free of carbon smut and/or more receptive to phosphatizing and subsequent painting by adding to the rolling oil from about 0.5 to 5% by weight of additive, based on the weight of the rolling oil and additive, of specific organic nitro compounds. The organic nitro compounds are one or more members selected from the group consisting of 2,4-dinitro benzoic acid, 2,5-dinitro benzoic acid, 3,4-dinitro benzoic acid, 3,5-dinitro benzoic acid, picric acid, 1,3-dinitro benzene, 2,4,6-trinitro toluene, 3,5-dinitro salicylic acid, 2-amino-6-nitrobenzothiazole, poly glycol ester of 3,5-dinitro benzoic acid, dimethyl octyne diol ester of 3,5-dinitro benzoic acid, 2,4,7-trinitro-9-fluorenone and 1,5-difluoro-2,4-dinitro benzene.

Following cold rolling of the steel sheet or strip in contact with the rolling oils of this invention and without further treatment, it is batch annealed. The processed steel may have additional surface treatments following annealing.

Another aspect of our invention is directed to a cold rolling lubricant composition comprising a conventional rolling oil which contains from 0.5 to 5% of one or more of the additives described above which inhibit the formation of carbon smut when the steel is batch annealed.

The rolling oil containing the smut inhibiting additive may be used undiluted in the cold rolling mill but generally it is used as an oil in water emulsion with the oil constituting from about 0.5 to 15% by weight of the combined oil and water.

DETAILED DESCRIPTION OF THE INVENTION

The chemicals which we add to conventional rolling lubricant to inhibit the formation of carbon smut during batch annealing are one or more members selected from the group consisting of 2,4-dinitro benzoic acid, 2,5-dinitro benzoic acid, 3,4-dinitro benzoic acid, 3,5-dinitro benzoic acid, picric acid, 1,3-dinitro benzene, 2,4,6-trinitro toluene, 3,5-dinitro salicylic acid, 2-amino-6-nitrobenzothiazole, poly glycol ester of 3,5-dinitro benzoic acid, dimethyl octyne diol ester of 3,5-dinitro benzoic acid, 2,4,7-trinitro-9-fluorenone and 1,5-difluoro-2,4-dinitro benzene. The smut inhibiting additives are incorporated into the cold rolling oil in an amount ranging from about 0.5 to 5% by weight based on the combined weight of the additive and rolling oil. In some cases, we have found 0.5% of the organic nitro compound to be an effective smut inhibitor but we prefer a minimum of about 1%. Amounts greater than 5% give no increased benefit. The smut inhibiting additives as well as other additives described below are easily incorporated in the cold rolling oil by conventional liquid mixing and blending equipment.

We have found that the organic nitro compounds which are effective smut inhibitors are either soluble in the rolling oil or are soluble in the water used to prepare oil in water emulsions which are then used as the rolling lubricant.

The cold rolling oil can be any conventional rolling oil available on the market today from a large number of suppliers. Typically, the cold rolling oil will be based on a mineral oil derived from either a naphthenic or paraffinic base. The mineral oil may vary from about 0 to 95% by weight of the rolling lubricant. The mineral oil will generally have a viscosity range of 150 to 350 S.U.S. Also, the rolling lubricant will generally have present from about 0 to 95% by weight of fatty acid esters such as tallow, white or yellow grease and lard derived primarily from oleic, palmitic and stearic acid esters of glycerol. The mineral oil and fatty acid esters in total must comprise at least about 80% by weight of the cold rolling oil. Either one or any mixture of the mineral oil and fatty acid ester totalling at least about 80% by weight of the rolling lubricant is satisfactory.

Small amounts of fatty acids may also be present such as tallow fatty acids and tall oil fatty acids composed primarily of oleic, stearic or palmitic fatty acids. The fatty acids will constitute about 0 to 10% by weight of the rolling lubricant.

The cold rolling oil or lubricant may also contain from about 0.1 to 0.5% antioxidants such as 2,6 di-tertiary butyl phenol; 2,6 di-tertiary butyl 4-n-butyl phenol; 2,6 di-tertiary butyl p-cresol; 4-hydroxymethyl 2,6 di-tertiary butyl phenol; butylated hydroxytoluene or 2,2' methylenebis (4-methyl 6-tert butylphenol). Also, about 0.05 to 1.0% by weight of a bactericide such as orthophenyl phenol; 2,4,5 trichlorophenol; pentachlorophenol; o-benzyl p-chlorophenol; or hexahydro-1,3,5 tris(2-hydroxyethyl-S-triazine) is very desirable and in many cases necessary. Perfumes at a concentration of about 0.1 to 0.3% by weight and defoaming agents at a concentration of about 0.05 to 1.0% by weight may also be present. Typical defoaming agents include dimethyl silicone and dimethyl polysiloxane as well as many others of undisclosed composition.

A typical cold rolling oil or rolling lubricant will have the following composition expressed as percent by weight: mineral oil—45%, yellow grease—44%, smut inhibitor (2,4,6-trinitrotoluene)—1%, fatty acid (tallow fatty acid)—4%, emulsifier (nonylphenol ethoxylate)—5.7%, antioxidant (2.6-ditertiarybutylphenol-)—0.1%, perfume—0.1%, bactericide (o-phenylphenol-)—0.05% and defoamer (silicone fluid)—0.05%.

The rolling oils with the 0.5 to 5% by weight of organic nitro compound smut inhibitor may be used neat but generally for economic reasons the rolling oils are used as oil in water emulsions. The amount of rolling oil emulsified in water will vary from about 0.5 to 15% by weight based on the combined weight of the oil and water. The oil in water emulsion can be prepared by adding the rolling oil to the water in a mixing tank using a high speed stirrer. In order to prepare the oil in water emulsion it is necessary that an emulsifying agent be present in the rolling oil at a concentration of about 0.5 to 10% by weight. If desired, the emulsifying agent can be added to the water used to prepare the oil in water emulsion.

The emulsifier used in preparing the oil in water emulsion can be any conventional emulsifying agent. Typical emulsifying agents are the ethoxylated alkyl phenols in which the alkyl groups may be within the range of $C_8$ to $C_{18}$ and the moles of ethylene oxide range from 5 to 12 units. Typical ethoxylated alkyl phenols are octy phenol, nonyl phenol, dodecyl phenol and dinonyl phenol ethoxylates.

Another class of emulsifiers useful in our invention is the ethoxylated linear and branched chain primary alcohols of $C_8$ to $C_{16}$ carbon content and having about 5 to 12 moles of ethylene oxide per mole of alcohol. Tridecyl alcohol ethoxylate is an example.

Another class of emulsifiers is the ethoxylated fatty amines of $C_{11}$ to $C_{18}$ and having about 5 to 15 moles of ethylene oxide per mole of fatty amine. Examples of this class of emulsifier are oleyl amine, octadecyl amine and coco amine ethoxylates.

The polyethylene oxide glycol esters of $C_{12}$ to $C_{18}$ fatty acids having about 5 to 15 moles of ethylene oxide per mole of fatty acid are also good emulsifiers for oil in water emulsions. This class of emulsifiers includes polyoxyethylene glycol oleate (5 to 15 moles of ethylene oxide, polyoxyethylene glycol stearate (5 to 15 moles of ethylene oxide) and polyoxyethylene glycol laurate (5 to 15 moles ethylene oxide).

In order to achieve good plate-out of the rolling oil on the steel it has been found that the pH of the aqueous emulsion must be within the range of about pH 4 to 8. When acidic components are introduced into the rolling oils such as by using nitrated benzoic acid or nitrated salicylic acid smut inhibitors or by using acidic emulsifying agents an alkaline type pH modifier is required. Generally, the rolling oil will contain about 0 to 8% by weight of the pH modifier. The percent by weight of the pH modifier is determined largely by trial and error experiments.

We have found the aliphatic amines of $C_2$ to $C_{12}$ range to be satisfactory pH modifiers. Typical amines are morpholine, di-n-butylamine, di-n-propylamine and di-hexylamine; useful aromatic amines are aniline, pyridine and diphenylamine.

A typical rolling oil containing a carbon smut inhibitor together with a pH modifier has the following composition expressed as percent by weight: Blend of palmitic, stearic and oleic acid esters of glycerol—67%; paraffinic mineral oil (200 SUS)—22.9%; blends of palmitic, stearic and oleic acids (fatty acid)—5.5%; nonyl phenol ethoxylate (9 moles EO) (emulsifier)—2.2%; 3,5 dinitro benzoic acid (smut inhibitor)—1.0%; morpholine (pH modifier)—1.0%; o-phenyl phenol (biocide)—0.2%; butylated hydroxytoluene (antioxidant-)—0.1%; and odor masking perfume—0.1%. (Total—100%).

Cold rolling lubricants described above containing 1 and 5% by weight respectively of the various carbon smut inhibitors were evaluated for postannealing inhibition of carbon smut by the following procedure.

EXAMPLE 1

Each of the rolling oil compositions as prepared in Example I is emulsified in water at 10% by volume to provide an emulsion having a concentration which will yield and oil coating weight on steel approximately equal to that obtained under production conditions. Steel test panels are dipped in each 10% emulsion until thoroughly coated and then supported vertically on paper towels until the water has evaporated, leaving an oil coating on the steel. These prepared panels are then stacked and bolted between two steel plates after which they are stored overnight at 250° F. to simulate a tightly wound steel coil from a rolling mill.

To simulate batch annealing, this stack of panels is placed in an inert gas atmosphere retort furnace of 6 liter volume. The gas used is 95% nitrogen/5% hydrogen at a flow rate of 300 cc. per minute. The steel panels were annealed in this furnace at 1250° F. for 10 hours. After cooling, the panels were observed visually.

After annealing, the panels were rated for amount of smut by visual inspection. For each variation, sets of 6 panels were prepared. Up to 11 sets could be tested in one stack. In each annealing run, one control set of oiled panels without additives was included as a control, against which the sets with additives were rated. It is not possible to attach absolute numerical values to the visual appearance, because the quality of steel as manufactured in a mill does vary enough from batch to batch, even for the same grade of steel to result in differences in appearance. We made reasonably sure that we at least used the same batch of steel for one run and judged the appearance of the sets relative to each other. The observations of smut inhibition are shown in Table I below.

EXAMPLE II

The next step in the test procedure was the phosphate coating of the panels treated in Example I. This was done as follows:

The panels were cleaned in a commercial heavy duty alkaline cleaner at 200° F. temperature and of 8 oz/gal concentration by brushing and 1 minute immersion. The panels were water rinsed and spray coated 1 minute at 135° F. with a commercial zinc phosphate coating bath of 12 points concentration. Such a bath consists essentially of a water solution of about 1% of acid zinc phosphate with minor amounts of acid nickel phosphate and nitric acid, operated at a pH close to the precipitation point of tertiary zinc phosphate.

For each anneal test run, a set of non-annealed good grade of steel panels were phosphate coated and painted. Also, the panels were spray painted with about 0.0015" of a commercial high bake appliance alkyd enamel and baked according to specification.

Next, the painted surface of each panel was scored with a steel scribe down to metal by making two lines diagonally from corner to opposite corner. The panels were then placed in a salt spray cabinet and exposed to salt spray for 10 days at 95° F. and a salt concentration of 5%, according to test method ASTM B117.

After the test was finished, the panels were rated for the width of corrosion creep from the scribe line according to ASTM D1654. This specification uses a scale from 0 to 10 for judgement, 10 being a perfect score, i.e. no corrosion creep at all; 9 having traces of corrosion, 6=$\frac{1}{8}$" creep, 4=$\frac{1}{4}$" and 0 more than one inch. For all practical purposes, a rating below 6 is usually considered failing, although for some inexpensive low cost finishes, figures even as low as 4 might be acceptable. Results of 8 (1/32" creep) and higher are considered excellent.

We have found generally that annealed panels with less visual carbon deposits did result in better salt spray resistance. However, there were some additives that did not improve the appearance at all, compared to the control, but still did improve the salt spray resistance.

The smut inhibiting compounds described heretofore, all used at the 1% and the 5% level in the rolling oil, have been found to improve the appearance and/or salt spray resistance of the annealed steel. The results are presented in Table I. In Table I, each subdivision represents a different stack of steel with each stack having its own untreated (control) panel.

TABLE I(a)

| Smut Inhibitor | Concentration | Oil Coating Weight | Appearance after Anneal | Phosphate Coating Weight | Results Salt Spray ASTM-D 1654 | Remarks |
|---|---|---|---|---|---|---|
| None | — | 145 mg/ft$^2$ | — | 290 mg/ft$^2$ | 4.0 | ASTM-D: 10 = perfect score, 0 = complete failure |
| 3,5-DNBA | 1% | 120 mg/ft$^2$ | better than control | 350 mg/ft$^2$ | 4.0 | No pH adjustment |
| 3,5-DNBA | 1% | 147 mg/ft$^2$ | better than control | 319 mg/ft$^2$ | 5.0 | pH adjusted with ammonia |
| 3,5-DNBA | 5% | 146 mg/ft$^2$ | better than control | 370 mg/ft$^2$ | 8.0 | pH adjusted with ammonia |
| Picric Acid | 1% | 200 mg/ft$^2$ | worse than control | 252 mg/ft$^2$ | 3.0 | no pH adjustment - emulsion split |
| Picric Acid | 5% | 362 mg/ft$^2$ | better than control | 320 mg/ft$^2$ | 5.0 | no pH adjustment - emulsion split |
| Picric Acid | 1% | 137 mg/ft$^2$ | better than control | 323 mg/ft$^2$ | 4.0 | pH adjusted with ammonia |
| Picric Acid | 5% | 156 mg/ft$^2$ | better than control | 329 mg/ft$^2$ | 6.5 | pH adjusted with ammonia |

16 DNBA = dinitrobenzoic acid

TABLE I(b)

| Smut Inhibitor | Concentration | Oil Coating Weight | Appearance after Anneal | Phosphate Coating Weight | Results Salt Spray ASTM-D 1654 | Remarks |
|---|---|---|---|---|---|---|
| None (control) | — | 120 mg/ft$^2$ | — | 257 mg/ft$^2$ | 4.5 | — |
| 3,5-DNBA | 1% | 155 mg/ft$^2$ | better than control | 247 mg/ft$^2$ | 7.0 | pH adjusted with ammonia |

TABLE I(b)-continued

| Smut Inhibitor | Concen-tration | Oil Coating Weight | Appearance after Anneal | Phosphate Coating Weight | Results Salt Spray ASTM-D 1654 | Remarks |
|---|---|---|---|---|---|---|
| 3,5-DNBA | 5% | 133 mg/ft$^2$ | better than control | 242 mg/ft$^2$ | 8.5 | pH adjusted with ammonia |
| 2,5-DNBA | 1% | 148 mg/ft$^2$ | better than control | 235 mg/ft$^2$ | 6.0 | pH adjusted with ammonia |
| 2,5-DNBA | 5% | 139 mg/ft$^2$ | better than control | 308 mg/ft$^2$ | 7.0 | pH adjusted with ammonia |
| 3,4-DNBA | 1% | 123 mg/ft$^2$ | like control | 286 mg/ft$^2$ | 4.5 | pH adjusted with ammonia |
| 3,4-DNBA | 5% | 150 mg/ft$^2$ | like control | 312 mg/ft$^2$ | 7.0 | pH adjusted with ammonia |
| 3,5-Dinitro Salicylic Acid | 1% | 137 mg/ft$^2$ | worse than control | 330 mg/ft$^2$ | 5.0 | pH adjusted with ammonia |
| 3,5-Dinitro Salicylic Acid | 5% | 136 mg/ft$^2$ | worse than control | 337 mg/ft$^2$ | 6.5 | pH adjusted with ammonia |

DNBA = dinitrobenzoic acid

TABLE I(c)

| Smut Inhibitor | Concen-tration | Oil Coating Weight | Appearance after Anneal | Phosphate Coating Weight | Results Salt Spray ASTM D-1654 | Remarks |
|---|---|---|---|---|---|---|
| None (control) | — | 128 mg/ft$^2$ | — | 310 mg/ft$^2$ | 4.0 | — |
| 3,5-DNBA | 1% | 136 mg/ft$^2$ | better than control | 332 mg/ft$^2$ | 7.5 | pH adjusted with ammonia |
| 3,5-DNBA | 5% | 135 mg/ft$^2$ | better than control | 332 mg/ft$^2$ | 8.5 | pH adjusted with ammonia |
| 2,4-dinitro phenol | 1% | 140 mg/ft$^2$ | better than control | 287 mg/ft$^2$ | 6.5 | pH adjusted with ammonia |
| 2,4-dinitro phenol | 5% | 131 mg/ft$^2$ | better than control | 302 mg/ft$^2$ | 8.0 | pH adjusted with ammonia |
| 2,4,6-trinitro toluene | 1% | 117 mg/ft$^2$ | better than control | 284 mg/ft$^2$ | 8.5 | — |
| 2,4,6-trinitro toluene | 5% | 131 mg/ft$^2$ | better than control | 245 mg/ft$^2$ | 6.0 | — |
| 2-amino-6-nitrobenzo-thiazole | 1% | 136 mg/ft$^2$ | better than control | 241 mg/ft$^2$ | 8.5 | — |
| 2-amino-6-nitrobenzo-thiazole | 1% | 152 mg/ft$^2$ | worse than control | 246 mg/ft$^2$ | 9.0 | Appearance after anneal worst of this run. However, surface structure apparently was modified in such a way that salt spray performance was best. |

DNBA = dinitrobenzoic acid

TABLE I(d)

| Smut Inhibitor | Concen-tration | Oil Coating Weight | Appearance after Anneal | Phosphate Coating Weight | Results Salt Spray ASTM-D 1654 | Remarks |
|---|---|---|---|---|---|---|
| None (control) | — | 133 mg/ft$^2$ | — | 337 mg/ft$^2$ | 4.0 | — |
| 2,4,6-trinitro toluene | 1% | 136 mg/ft$^2$ | better than control | 383 mg/ft$^2$ | 6.0 | — |
| 2,4,6-trinitro toluene | 5% | 137 mg/ft$^2$ | better than control | 352 mg/ft$^2$ | 8.5 | — |
| Polyglycol ester of 3,5-DNBA (Carbowax 500 ester) | 1% | 146 mg/ft$^2$ | Like content | 316 mg/ft$^2$ | 4.0 | — |
| Polyglycol ester of 3,5-DNBA (Carbowax 500 ester) | 5% | better than | 314 mg/ft$^2$ control | 6.5 | — | |
| Dimethyl octyne diol ester of 3,5-DNBA | 1% | 146 mg/ft$^2$ | worse than control | 323 mg/ft$^2$ | 3.5 | — |
| Dimethyl octyne diol ester of 3,5-DNBA | 5% | 145 mg/ft$^2$ | worse than control | 296 mg/ft$^2$ | 8.0 | — |

DNBA = dinitrobenzoic acid

TABLE I(e)

| Smut Inhibitor | Concentration | Oil Coating Weight | Appearance after Anneal | Phosphate Coating Weight | Results Salt Spray ASTM D-1654 | Remarks |
|---|---|---|---|---|---|---|
| None (control) | — | 116 mg/ft$^2$ | — | 227 mg/ft$^2$ | 5.5 | — |
| 2,4-DNBA | 1% | 134 mg/ft$^2$ | better than control | 257 mg/ft$^2$ | 8.5 | pH adjusted with ammonia |
| 2,4-DNBA | 5% | 129 mg/ft$^2$ | better than control | 269 mg/ft$^2$ | 9.5 | pH adjusted with ammonia |
| 2,5-DNBA | 1% | 126 mg/ft$^2$ | better than control | 275 mg/ft$^2$ | 9.0 | pH adjusted with ammonia |
| 2,5-DNBA | 5% | 117 mg/ft$^2$ | worse than control | 275 mg/ft$^2$ | 9.0 | pH adjusted* with ammonia |
| 3,4-DNBA | 1% | 112 mg/ft$^2$ | worse than control | 288 mg/ft$^2$ | 8.0 | pH adjusted* with ammonia |
| 3,4-DNBA | 5% | 137 mg/ft$^2$ | worse than control | 292 mg/ft$^2$ | 8.5 | pH adjusted* with ammonia |
| 3,5-DNBA | 1% | 127 mg/ft$^2$ | worse than control | 248 mg/ft$^2$ | 8.0 | pH adjusted* with ammonia |
| 3,5-DNBA | 5% | 117 mg/ft$^2$ | worse than control | 278 mg/ft$^2$ | 9.0 | pH adjusted* with ammonia |

*good salt spray performance in spite of poor appearance after anneal
DNBA = dinitrobenzoic acid

TABLE I(f)

| Smut Inhibitor | Concentration | Oil Coating Weight | Appearance after Anneal | Phosphate Coating Weight | Results Salt Spray ASTM D-1654 | Remarks |
|---|---|---|---|---|---|---|
| None (control) | — | 188 mg/ft$^2$ | — | 312 mg/ft$^2$ | 3.5 | — |
| 2,4,6-trinitro toluene | 5 | 107 mg/ft$^2$ | better than control | 351 mg/ft$^2$ | 6.0 | — |
| 2,4,6-trinitro toluene | 5% | 210 mg/ft$^2$ | worse than control | 356 mg/ft$^2$ | 6.5 | — |
| 1,5-difluoro-2,4-dinitro-benzene | 1% | 84 mg/ft$^2$ | worse than control | 326 mg/ft$^2$ | 5.0 | — |
| 1,5-difluoro-2,4-dinitro-benzene | 5% | 118 mg/ft$^2$ | like control | 322 mg/ft$^2$ | 6.0 | — |
| 3,5-DNBA | 1% | 387 mg/ft$^2$ | worse than control | 392 mg/ft$^2$ | 3+ | Laboratory technician overheated the oil after the smut inhibitor was added, resulting in substandard performance |
| 3,5-DNBA | 5% | 187 mg/ft$^2$ | worse than | 416 mg/ft$^2$ | 3.5+ | Laboratory technician overheated the oil after the smut inhibitor was added, resulting in substandard performance |

DNBA = dinitrobenzoic acid

TABLE I(g)

| Smut Inhibitor | Concentration | Oil Coating Weight | Appearance after Anneal | Phosphate Coating Weight | Results Salt Spray ASTM D-1654 | Remarks |
|---|---|---|---|---|---|---|
| None (control) | — | 118 mg/ft$^2$ | — | 388 mg/ft$^2$ | 3.0 | — |
| 2,4,6-trinitro toluene | 1% | 176 mg/ft$^2$ | better than control | 369 mg/ft$^2$ | 5.5− | — |
| 2,4,6-trinitro toluene | 5% | 180 mg/ft$^2$ | worse than control | 314 mg/ft$^2$ | 5.5 | — |
| 2,4,7-trinitro-9-fluorenone | 1% | 123 mg/ft$^2$ | worse than control | 500 mg/ft$^2$ | 4.0 | — |
| 2,4,7-trinitro-9-fluorenone | 5% | 182 mg/ft$^2$ | worse than control | 284 mg/ft$^2$ | 6.0 | — |

We claim:

1. In a process for producing steel sheet or strip substantially free of carbon smut deposits from cold rolled steel sheet or strip the improvement comprising cold rolling the steel sheet or strip in contact with a rolling oil containing about 0.5 to 5% by weight of one or more organic nitro-compounds selected from the group consisting of 2,4-dinitro benzoic acid, 2,5-dinitro benzoic acid, 3,4-dinitro benzoic acid, 3,5-dinitro benzoic acid, picric acid, 1,3-dinitro benzene, 2,4,6-trinitro toluene, 3,5-dinitro salicylic acid, 2-amino-6- nitrobenzothiazole, poly glycol ester of 3,5-dinitro benzoic acid, dimethyl octyne diol ester of 3,5-dinitro benzoic acid, 2,4,7-trinitro-9-fluorenone and 1,5-difluoro-2,4-dinitro benzene and thereafter without further treatment batch annealing the steel strip.

2. The process of claim 1 in which the amount of the organic nitro compound carbon smut inhibitor in the rolling oil ranges from about 1 to 5% by weight based on the mixture of organic nitro compound and rolling oil.

3. The process of claim 1 in which the rolling oil containing the organic nitro compound carbon smut inhibitor is emulsified in water.

4. The process of claim 3 in which the rolling oil comprises 2 to 20% by weight of the mixture of rolling oil and water.

5. The process of claim 1 in which a pH modifier is present in the rolling oil at a concentration of 0 to 8% by weight.

6. The process of claim 1 in which an aliphatic amine of $C_2$ to $C_{12}$ content is present in the rolling oil at a concentration of 0 to 8% by weight to control acidity.

7. A rolling lubricant for cold rolling steel sheet or strip comprising a rolling oil containing from 0.5 to 5% by weight of one or more members selected from the group consisting of 2,4-dinitro benzoic acid, 2,5-dinitro benzoic acid, 3,4-dinitro benzoic acid, 3,5-dinitro benzoic acid, picric acid, 1,3-dinitro benzene, 2,4,6-trinitro toluene, 3,5-dinitro salicylic acid, 2-amino-6-nitrobenzothiazole, poly glycol ester of 3,5-dinitro benzoic acid, dimethyl octyne diol ester of 3,5-dinitro benzoic acid, 2,4,7-trinitro-9-fluorenone and 1,5-difluoro-2,4-dinitro benzene.

8. An aqueous emulsion of the rolling lubricant of claim 7 at a concentration of 0.5 to 15% by weight of rolling lubricant based on the combined weight of rolling lubricant and water.

* * * * *